US008596328B2

(12) United States Patent
Anderson et al.

(10) Patent No.: US 8,596,328 B2
(45) Date of Patent: Dec. 3, 2013

(54) BAIL LOCK FOR COVERINGS FOR ARCHITECTURAL OPENINGS

(75) Inventors: Richard Anderson, Whitesville, KY (US); Robert E. Fisher, II, Owensboro, KY (US)

(73) Assignee: Hunter Douglas Inc., Pearl River, NY (US)

( * ) Notice: Subject to any disclaimer, the term of this patent is extended or adjusted under 35 U.S.C. 154(b) by 50 days.

(21) Appl. No.: 13/413,093

(22) Filed: Mar. 6, 2012

(65) Prior Publication Data

US 2013/0062022 A1 Mar. 14, 2013

Related U.S. Application Data

(60) Provisional application No. 61/450,387, filed on Mar. 8, 2011.

(51) Int. Cl.
*E06B 9/324* (2006.01)

(52) U.S. Cl.
USPC ..... 160/170; 160/178.2

(58) Field of Classification Search
USPC ..... 160/178.2, 170, 168.1 R
See application file for complete search history.

(56) References Cited

U.S. PATENT DOCUMENTS

| | | | | |
|---|---|---|---|---|
| 2,091,032 | A * | 8/1937 | Dodge | 160/168.1 R |
| 6,536,503 | B1 | 3/2003 | Anderson | |
| 7,597,131 | B2 * | 10/2009 | Nien et al. | 160/178.2 |
| 7,775,254 | B2 * | 8/2010 | Judkins et al. | 160/178.2 |
| 2005/0056384 | A1 | 3/2005 | Dekker et al. | |
| 2006/0118248 | A1 | 6/2006 | Anderson et al. | |
| 2007/0175594 | A1 | 8/2007 | Jelic | |
| 2012/0118515 | A1 * | 5/2012 | Chen | 160/170 |
| 2013/0062022 | A1 * | 3/2013 | Anderson et al. | 160/84.04 |

FOREIGN PATENT DOCUMENTS

WO WO2005009875 2/2005

* cited by examiner

*Primary Examiner* — Blair M. Johnson
(74) *Attorney, Agent, or Firm* — Camoriano and Associates

(57) ABSTRACT

A bail lock for coverings for architectural openings wherein at least one of the bails defines a cord guide surface of changing front-to-back cross-sectional profile so as to define a cord passage between the inner and outer bails that varies from a relatively straight path that allows the cord to pass freely through, to a more tortuous path that applies substantial frictional force to the cord.

8 Claims, 16 Drawing Sheets

BAIL LOCK FOR COVERINGS FOR ARCHITECTURAL OPENINGS

This application claims priority from U.S. Provisional Application Ser. No. 61/450,387 filed Mar. 8, 2011.

BACKGROUND OF THE INVENTION

The present invention relates to a bail lock for coverings for architectural openings, such a blinds or shades. More particularly it relates to a bail lock which has different zones of operation wherein the amount of friction applied to the cord varies across the width of the lock.

Typically, a blind transport system will have a head rail which both supports the blind and hides the mechanisms used to raise and lower or open and close the blind. One blind system is described in U.S. Pat. No. 6,536,503, Modular Transport System for Coverings for Architectural Openings (the '503 patent), which is hereby incorporated herein by reference. In the typical top/down product, the raising and lowering of the blind is done by a lift cord or lift cords suspended from the head rail and attached to the bottom rail (also referred to as the moving rail or bottom slat). The opening and closing of the blind is typically accomplished with ladder tapes (and/or tilt cables) which run along the front and back of the stack of slats. The lift cords usually run along the front and back of the stack of slats or through holes in the middle of the slats. In these types of blinds, the force required to raise the blind is at a minimum when the blind is fully lowered (fully extended), since the weight of the slats is supported by the ladder tape so that only the bottom rail is being raised at the outset. As the blind is raised further, the slats stack up onto the bottom rail, transferring the weight of the slats from the ladder tape to the lift cords, so progressively greater lifting force is required to raise the blind as the blind approaches the fully raised (fully retracted) position. As the blind is raised and the lifting force increases, the holding force that must be applied to the cord in order to hold the blind in place also increases. This is also the case for most shades and other coverings in which a lift cord is used.

Typically, the lift cord is held in a fixed position by means of a bail lock or some other friction mechanism, which applies sufficient frictional force to the cord to prevent the blind from falling when the cord is released. A conventional bail lock grabs the cord anywhere across its width, as shown in FIGS. 19, 20, and 21. In the prior art, the cord that is grabbed by the bail lock usually is the lift cord itself. However, the '503 patent shows an arrangement in which a separate drive cord drives spools onto which the lift cords wrap for raising and lowering the covering, so the cord that is pulled by the user is not the actual lift cord but is a separate cord that drives the lifting mechanism. In that case, the bail lock would be grabbing the drive cord rather than the lift cord(s), but the drive cord also is operatively connected to the covering in order to extend and retract the covering. Regardless of which cord it is grabbing, the bail lock is typically made of steel and has relatively sharp edges which tend to abrade the cord. This situation is compounded when there are fewer cords of the same cross section present with the same total load, with the most fraying of the cord occurring when there is only a single cord passing through the bail lock.

SUMMARY

An embodiment of the present invention provides a bail lock with different zones of operation, where the frictional force applied to the cord changes across the width of the bail lock. The amount of bend in the cord as it passes between the bails varies from one side of the bail lock to the other so that, if the cord passes through one part of the bail lock, there is little or no bend in the cord, so a negligible friction force is applied to the cord, allowing free fall or easy, quick, controlled lowering of the blind or shade, and, if the cord passes through another part of the bail lock, there are more degrees of bend, possibly with a smaller radius, which causes a substantial frictional force to be applied to the cord. In an intermediate area, an intermediate amount of bending and of radius are applied to the cord. In effect, a bail lock mechanism is provided with both locked and unlocked areas within the same mechanism.

Note that throughout this specification the terms blind or shade may be used to signify a covering for architectural openings. Also, the terms "drive cord", "control cord" and "lift cord" may be used interchangeably to refer to the cord(s) which is pulled or released by the user to raise or lower the covering.

DESCRIPTION

Figure 1:
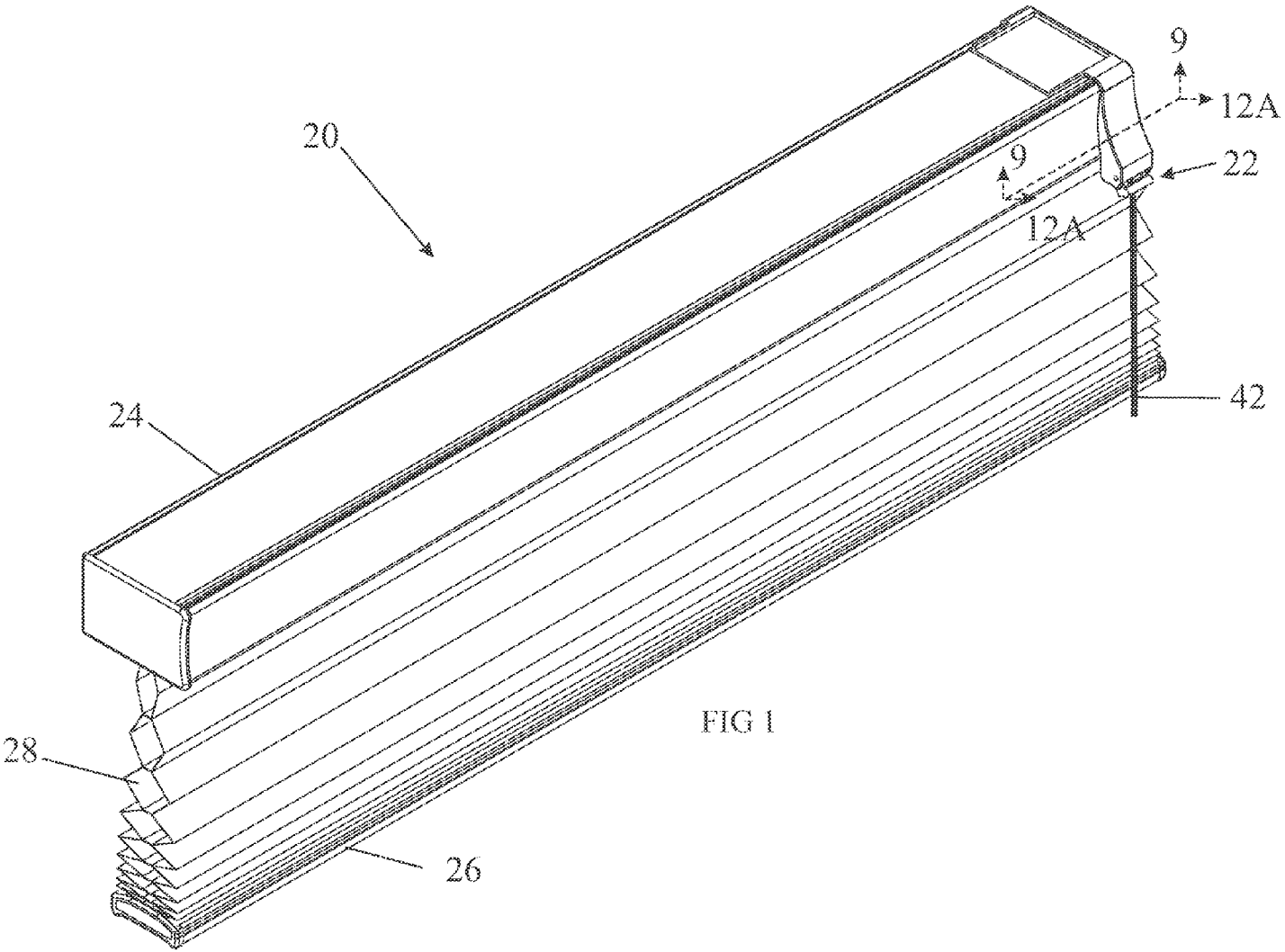
FIG. 1 is a perspective view of a pleated shade incorporating a drive with a bail lock mechanism, in the locked position, made in accordance with an embodiment of the present invention.

FIGS. 1 through 18 illustrate an embodiment of a horizontal covering 20 for an architectural opening using a bail lock 22 to hold the covering in the desired position. As shown in FIG. 1, the horizontal covering in this particular embodiment is a pleated shade 20. It should be noted that the bail lock 22 could be used for other types of coverings that use cords, such as a Venetian blind or a vertical blind.

Figure 2:
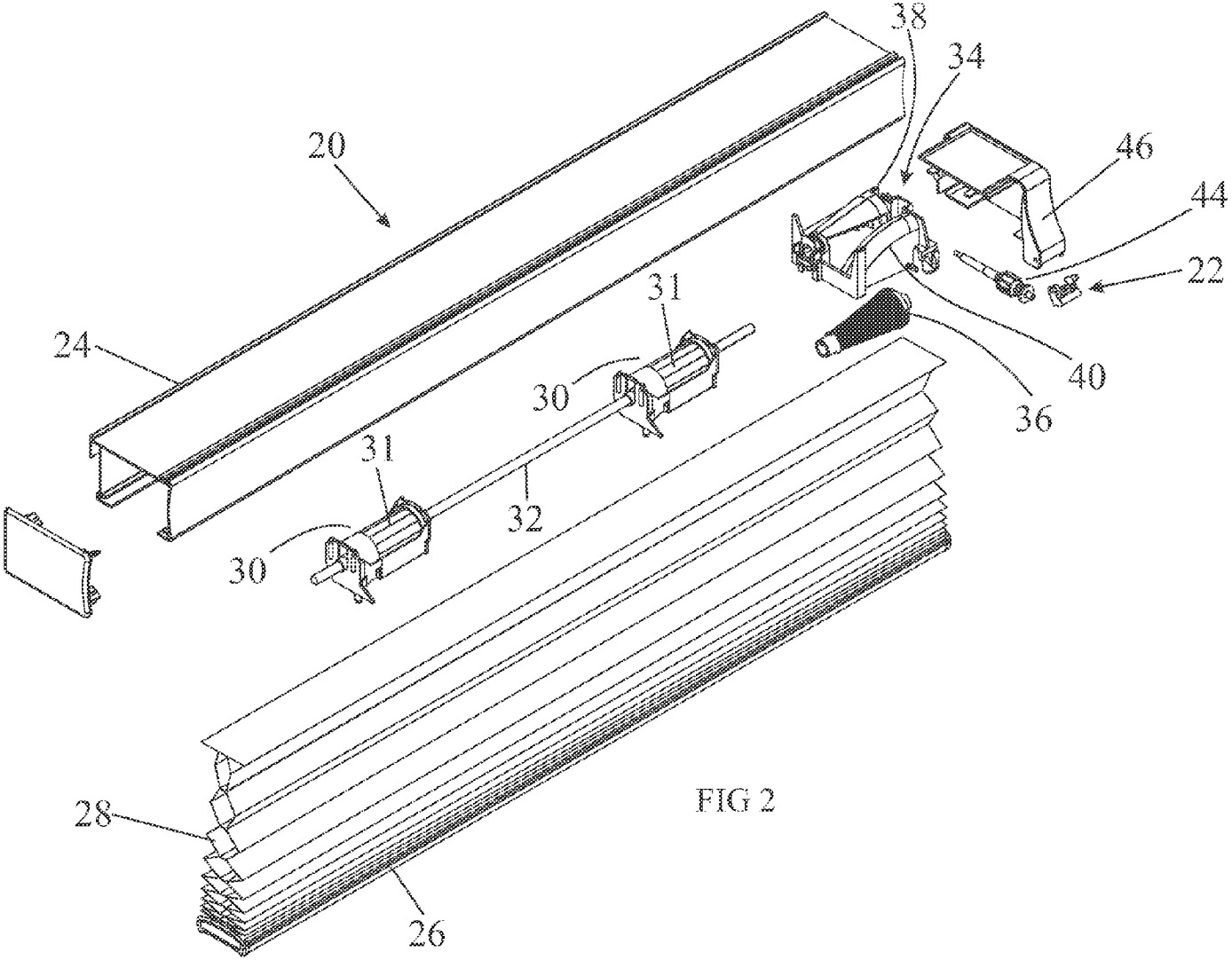
FIG. 2 is a partially exploded, perspective view of the shade of FIG. 1, showing the components housed in the head rail.

The shade 20 of FIGS. 1-2 includes a head rail 24, a bottom rail 26, and a pleated shade structure 28 suspended from the head rail 24 and attached to both the head rail 24 and the bottom rail 26. Lift cords (not shown) are attached to the bottom rail 26 and to lift spools 31 in lift stations 30 housed in the head rail 24. A lift rod 32 drives the lift spools 31 such that when the lift rod 32 rotates, the lift spools 31 on the lift stations 30 also rotate, and the lift cords wrap onto or unwrap from the lift spools 31 to raise or lower the bottom rail 26 and thus raise or lower the shade 20. The lift cords extend through openings in the shade structure 28. A cord drive 34 is functionally attached to the lift rod 32 and is used to raise or lower the shade 20 by pulling on or releasing a drive cord or control cord 42, as described in more detail below.

The lift stations 30 and their operating principles are disclosed in the '503 patent, which is hereby incorporated herein by reference. See particularly item 500 in FIGS. 8 and 104 of the '503 patent.

The cord drive 34 and its operating principle is disclosed in U.S. Patent application S.N. PCT/US04/22694 "Drive for Coverings for Architectural Openings" filed Jul. 15, 2004, International Publication No. WO 2005/009875 A2 published on Feb. 3, 2005 (the '875 reference), which is hereby incorporated herein by reference. See particularly item 102 in FIGS. 1, 11, 12, 16, and 17A-17C of the printed publication, and the operation description in page 26, line 32 to page 28, line 30.

Figure 19:
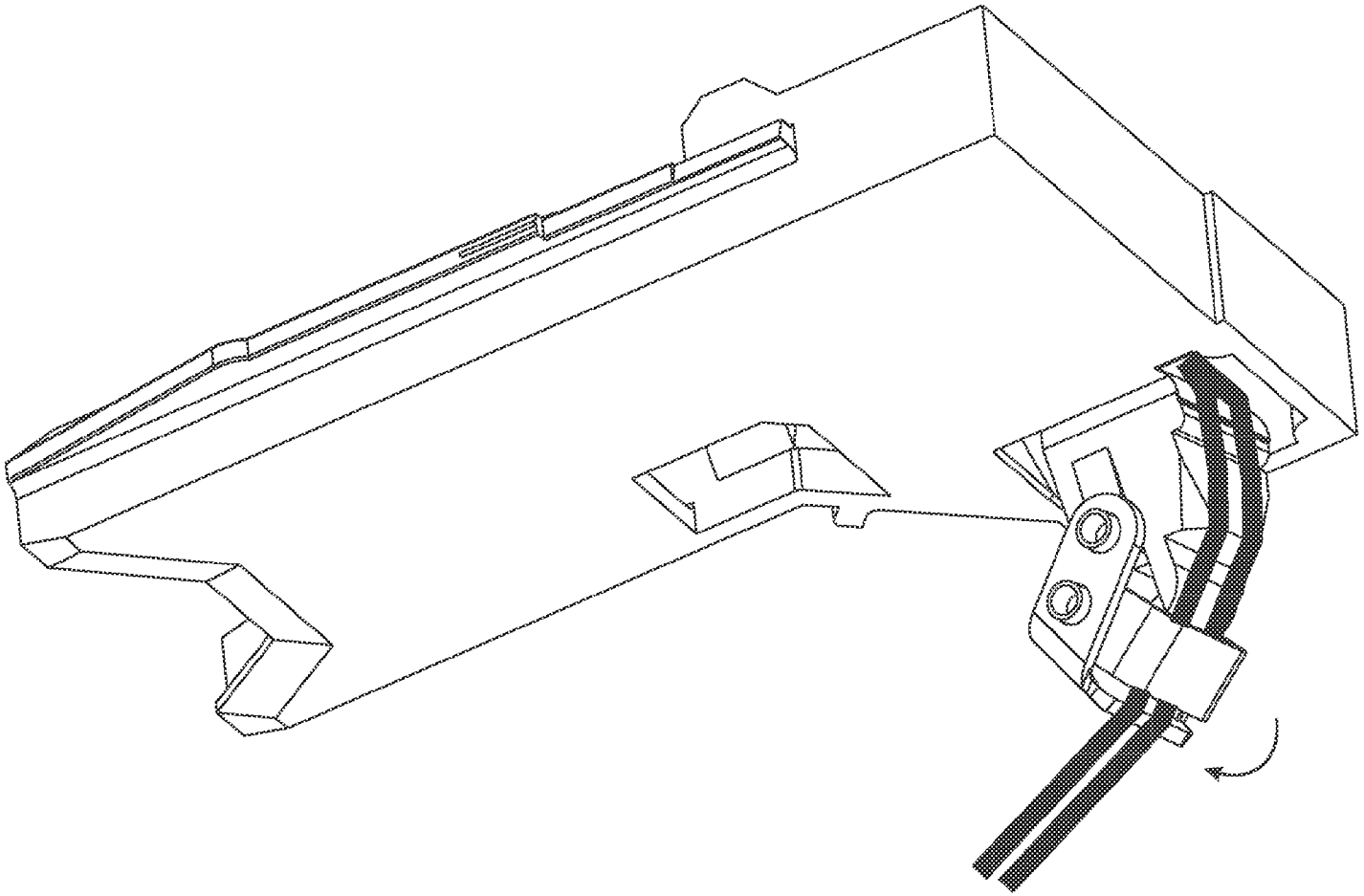
Prior Art FIG 19
FIG. 19 is a prior art bail lock in the unlocked position, including two lift cords.
Figure 20:
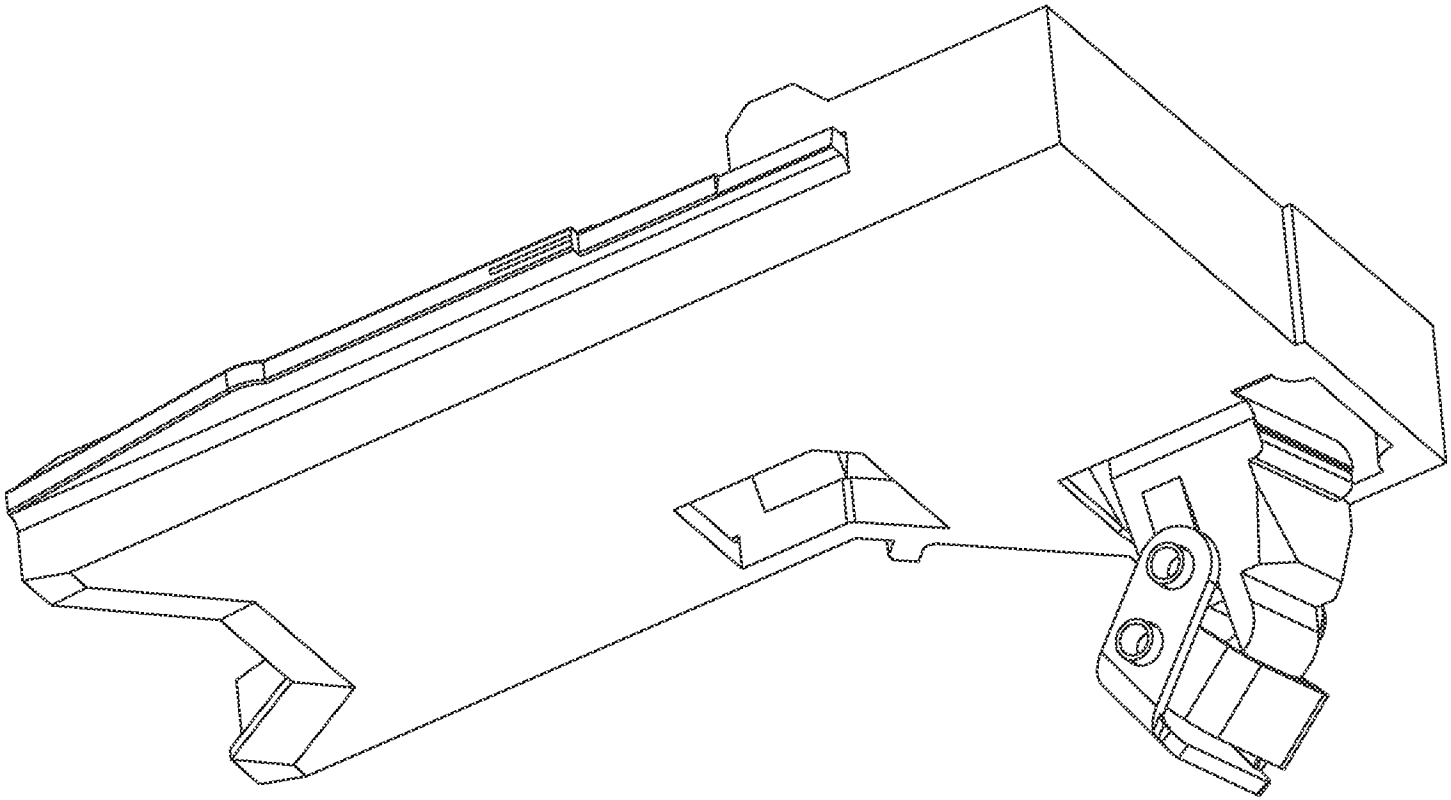
Prior Art FIG 20
FIG. 20 is the prior art bail lock of FIG. 19, in the unlocked position, with cords removed for clarity.
Figure 21:
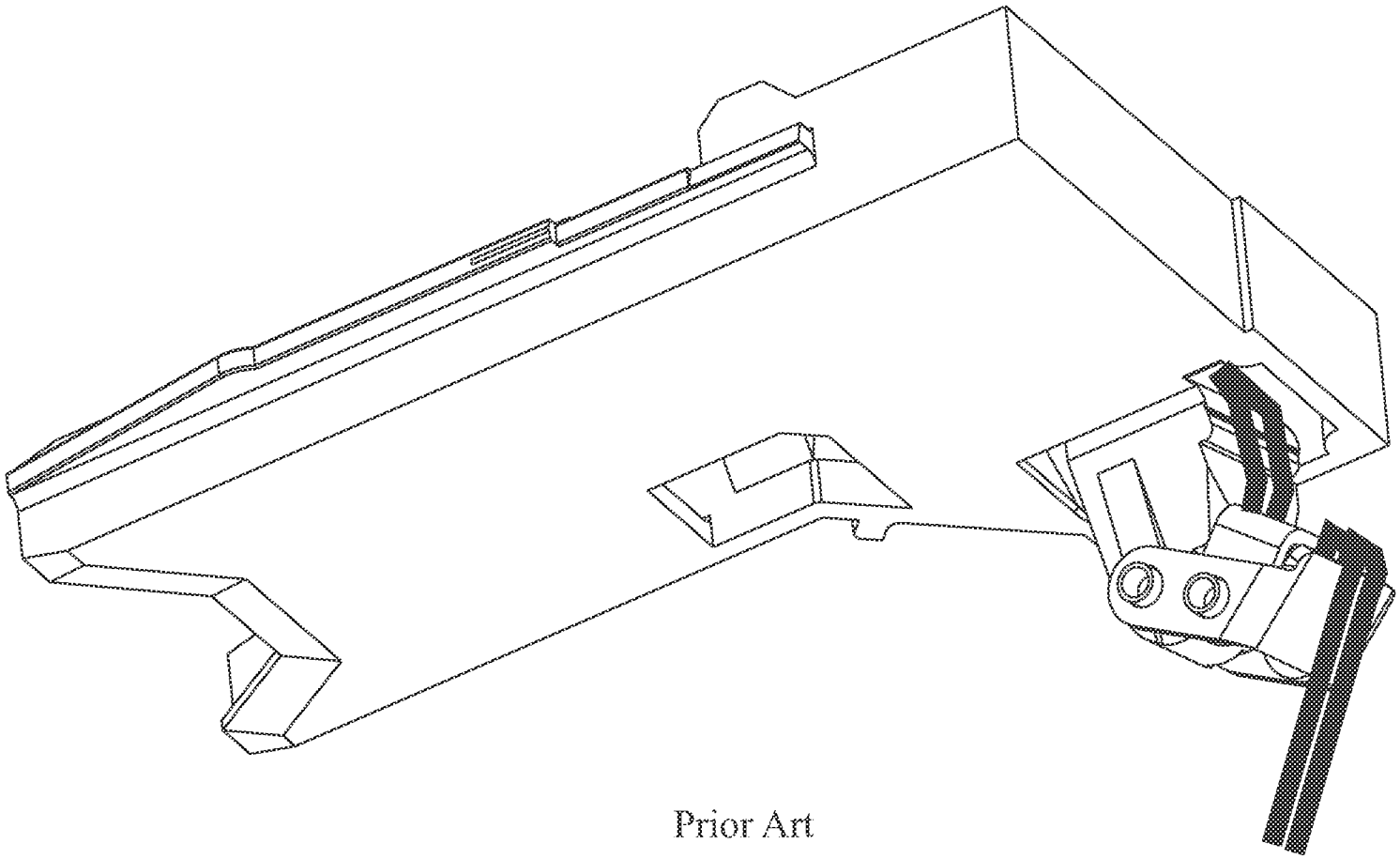
Prior Art FIG 21
FIG. 21 is the prior art bail lock of FIG. 19 in the locked position.

Note that the contoured guide surface 144 in the '875 publication reference has been slightly re-oriented and the capstan 132 has been rotated 90 degrees in the present embodiment (FIG. 2, item No. 44) such that its longitudinal axis is now perpendicular to the longitudinal axis of the spool 36 in FIG. 2 for a better fit within the confines of the head rail 24, but the operation is otherwise identical to that disclosed in the '875 reference. Additionally, FIGS. 7, and 23-28 of the '875 reference disclose the operation of the cord drive with the use of a locking dog which is similar to the prior art bail lock of FIGS. 19-21.

Referring to FIG. 2, the lift rod 32 is rotationally connected to the cord drive 34 (which includes a spool 36 mounted for rotation with the lift rod 32, a housing 38 for rotationally supporting the spool 36, a contoured guide surface 40 for guiding the drive cord 42 (See FIG. 1) onto the spool 36, a capstan 44 for locking the drive cord 42, and a bail lock housing 46 which both rotationally supports the capstan 44 and pivotably supports the bail lock mechanism 22), as described in more detail later.

A first end of the drive cord 42 is secured to the spool 36. The cord 42 is then is routed over the contoured guide surface 40, wraps around the capstan 44 and exits through an opening 104 (See FIG. 12A) in the bail lock housing 46 and through the bail lock mechanism 22 and the second end of the drive cord 42 is a free end, accessible to be pulled by a user. As the second end of the drive cord 42 is pulled down by the user, the cord 42 unwraps from the spool 36, the capstan 44 rotates about its longitudinal axis, and the cord passes through the bail lock 22 with minimal friction being applied by the bail lock. As discussed below, this causes the lift rod 32 and the lift stations 30 to rotate so as to wind the lift cords onto the lift stations 30, raising the shade 20.

When the user releases the drive cord 42, the bail lock mechanism 22 (if set in the closed or "lock" zone of the bail lock mechanism 22) applies a friction force to the drive cord 42, which acts as a load on the capstan 44 which "cinches" the wraps of the drive cord 42 onto the capstan 44 so no slippage occurs. The weight of the shade 20 urges the drive cord 42 upwardly to start winding back up onto the spool 36. This upward pull shifts the location of the capstan 44 in the bail lock housing 46 to a position where the capstan 44 is not allowed to rotate. Since the drive cord 42 cannot surge the capstan 44 (due to the load imparted by the bail lock mechanism 22 on the drive cord 42), and the capstan 44 is prevented from rotation, the shade 20 is locked in this position.

To lower the shade 20, the user releases the bail lock mechanism 22 which allows the drive cord 42 to surge the capstan 44. Even though the capstan 44 is still in a location which precludes its rotation, the drive cord 42 surges (slips) around the capstan 44 and winds up onto the spool 36 as the weight of the shade 20 causes the lift stations 30, the lift rod 32, and the spool 36 to rotate, as described below.

Each lift station 30 includes a lift spool 31 rotationally connected to the lift rod 32. The lift stations 30 are mounted in the head rail 24 and are connected to the lift rod 32 such that, when the lift rod 32 rotates, so do the lift spools 31 of the lift stations 30, and vice versa. The lift cords (not shown) are connected to the lift spools 31 of the lift stations 30 at one end, extend through openings in the covering material 28, and are connected to the bottom rail 26 at the other end, such that, when the lift spools 31 rotate in one direction, the lift cords wrap onto the lift spools 31 and the shade 20 is raised, and when the lift spools 31 rotate in the opposite direction, the lift cords unwrap from the lift spools 31 and the shade 20 is lowered.

As described in the '875 reference, page 28, lines 24-30: "Only a relatively small force is required to engage the drive cord onto the capstan such that no slippage occurs. In the present embodiment, a weight of less than 4 ounces can hold the drive cord taut onto the capstan 44 against a 15 pound force acting in the opposite direction to lower the window covering. As explained in the '875 reference with respect to a second embodiment involving a locking dog, this is an important consideration, as the locking dog only applies a small frictional force to hold the window covering in place, and this small force does not fray the drive cord.

As described below, this embodiment of the bail lock mechanism 22 includes generously radiused, plastic components to minimize fraying of the drive cord. This embodiment also includes different zones of operation, with the holding force depending upon where the cord 42 is tracking relative to the bail lock mechanism 22.

Bail Lock Mechanism

Figure 6:
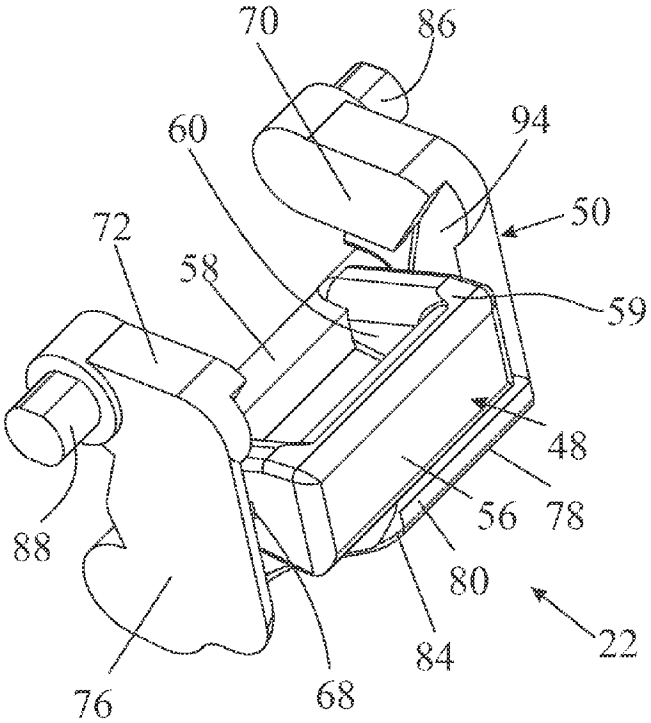
FIG. 6 is an assembled, perspective view of the bail lock of FIG. 5.

FIGS. 3-18 depict the bail lock mechanism 22 of FIG. 2. Referring to FIGS. 5 and 6, the bail lock mechanism 22 includes an inner bail 48 and an outer bail 50, and defines a cord passage gap between the inner bail 48 and the outer bail 50.

The inner bail 48 is a substantially rectangular body including left and right stiles 52, 54 and outer and inner rails 56, 58 defining a hollow rectangular area 60 framed in by the rails 56, 58 and stiles 52, 54. Axially aligned stub shafts 62, 64 project leftwardly and rightwardly from the left and right ends of the inner rail 58, and ramped fingers 66, 68 (see also FIGS. 7 and 8) project leftwardly and rightwardly from the left and right stiles 52, 54, respectively. The outer rail 56 defines a leading edge 57 and a trailing edge 59 opposite the leading edge 57.

The outer bail 50 includes left and right stiles 70, 72. Left and right arms 74, 76 project perpendicularly and outwardly from these stiles 70, 72 respectively, and a single, outer rail 78 interconnects the two arms 74, 76.

Figure 4:
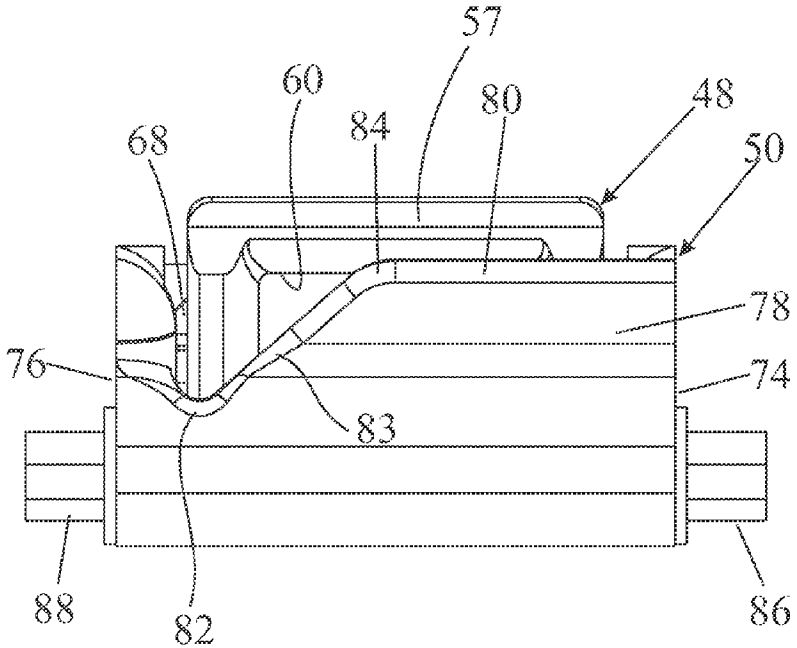
FIG. 4 is a front view of the bail lock of FIG. 3.
Figure 3:
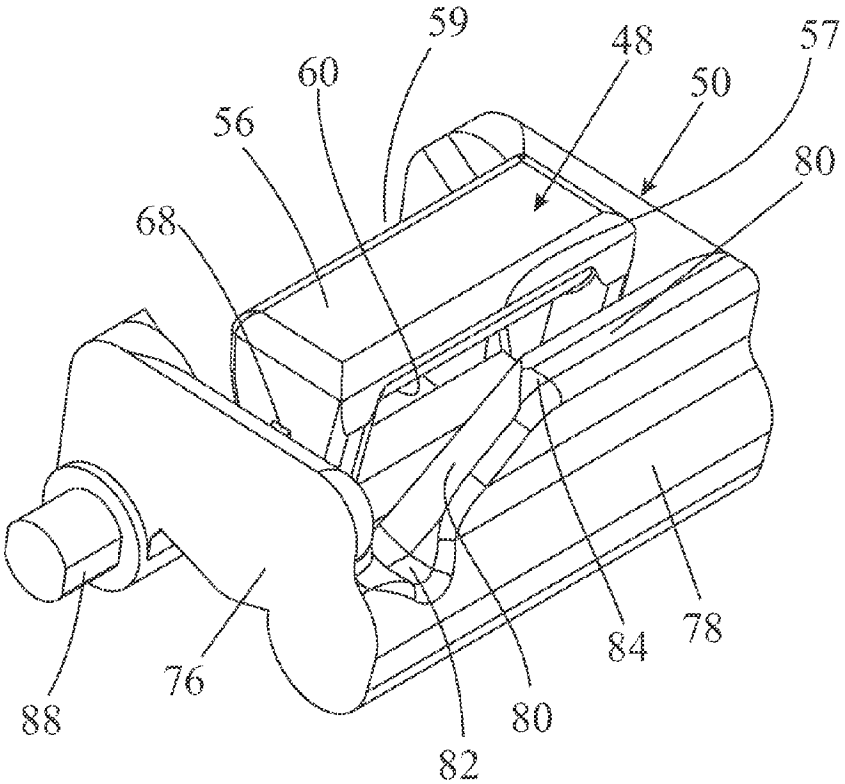
FIG. 3 is a perspective view of the bail lock of FIG. 2.
Figure 5:
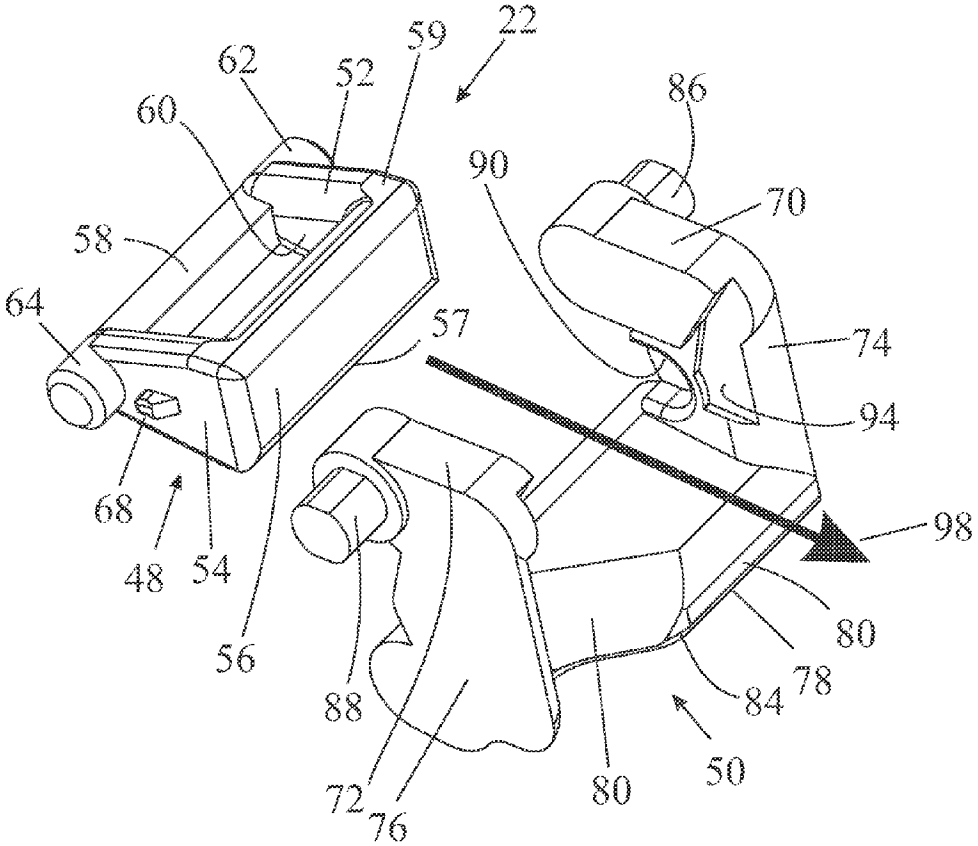
FIG. 5 is an exploded, perspective view of the bail lock of FIG. 3.

As best appreciated in FIGS. 3 and 4, the outer rail 78 defines a cord-contact surface 80 which extends from the left arm 74 to the right arm 76 of the outer bail 50. The cord-contact surface 80 varies in front-to-back cross-sectional profile from its left end to its right end. Specifically, in this example, it varies in height, with its lowest point 82 adjacent the right arm 76. The height then climbs steadily until it reaches its high point 84, and thereafter remains at that high level the rest of the width of the outer rail 78. The cord-contact surface 80 is a generously radiused and contoured surface without sharp edges which might tend to fray the drive cord.

Referring to FIGS. 5 and 6, the left and right stiles 70, 72 of the outer bail 50 have axially aligned stub shafts 86, 88 which project leftwardly and rightwardly from the left and right stiles 70, 72, respectively, and which define a left-to-right pivot axis and pivotably support the bail lock mechanism 22 on the bail lock housing 46 (See FIG. 2), as explained in more detail later. The left and right arms 74, 76 define axially aligned arched openings 90, 92 (only arched opening 90 is visible in FIG. 5, but arm 76 has a similar arched opening 92) which pivotably receive the stub shafts 62, 64 of the inner bail 48 when the bail lock mechanism 22 is assembled, for pivoting about a second left-to-right pivot axis, as described later.

Figure 8:
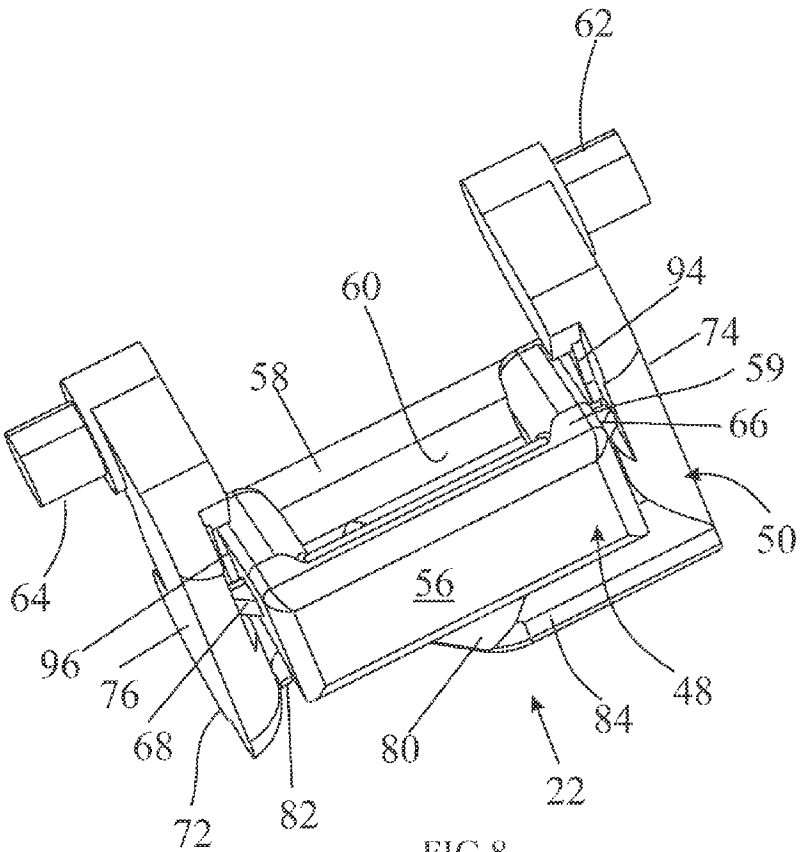
FIG. 8 is an assembled, perspective view of the bail lock of FIG. 7.
Figure 7:
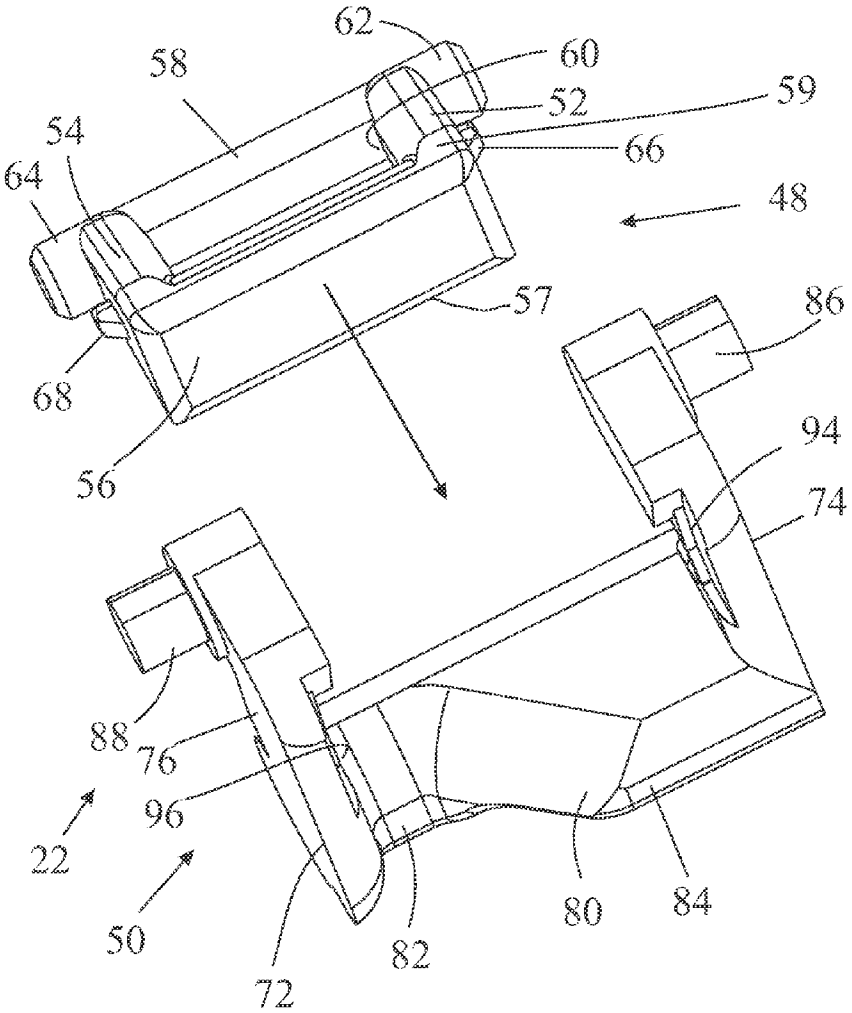
FIG. 7 is an exploded, perspective view of the bail lock of FIG. 5, seen from a slightly different angle.

As best appreciated in FIGS. 7 and 8, the left and right arms 74, 76 also define "carved-out" recesses or pockets 94 (See also FIG. 6), 96 which receive the ramped fingers 66, 68 to lock the inner bail 48 into the outer bail 50, so the inner bail 48 can pivot about the second left-to-right pivot axis relative to the outer bail 50 without falling out, as described in more detail later.

Assembly:

Referring to FIGS. 5 and 6, to assemble the bail lock mechanism 22, the inner bail 48 is inserted into the outer bail 50 in the direction shown by the arrow 98. The ramped surfaces of the fingers 66, 68 impact against the inner walls of the arms 74, 76, spreading the arms far enough apart for the fingers 66, 68 to slide along the inner walls of the arms 74, 76 until they reach the abruptly recessed pockets 94, 96, which allows the arms 74, 76 to snap back to their original positions. At this point, the stub shafts 62, 64 of the inner bail 48 are received in the arched openings 90, 92 of the outer bail 50, as shown in FIGS. 6 and 8. The inner bail 48 is now snap-mounted into the outer bail 50 and can rotate a small amount about the left-to-right axis of the stub shafts 62, 64 relative to the outer bail 50. The assembled bail lock mechanism 22 is then turned upside down, and the stub shafts 86, 88 of the outer bail 50 are snapped into downwardly projecting arms 100, 102 (See FIG. 12A) of the bail lock housing 46.

As has already been described, a first end of the drive cord 42 is secured to the spool 36 of the cord drive 34 (shown in FIG. 2). The second end of the drive cord 42 is routed over the guide surface 40 of the cord drive 34 and then wound one or more times (typically one to three times is sufficient) around the capstan 44 and out through an opening 104 (shown in FIG. 12A) in the bail lock housing 46.

Figure 12:
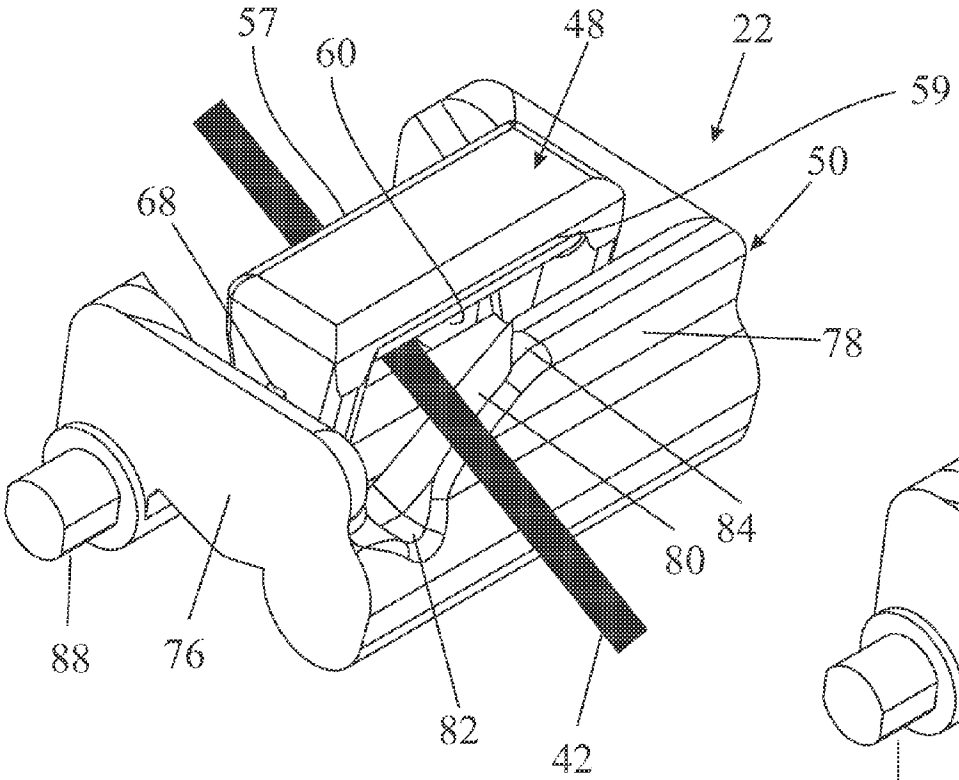
FIG. 12 is a perspective view of the bail lock of FIGS. 10 and 11, showing the drive cord tracked to the open (unlocked) area of the bail.
Figure 12A:
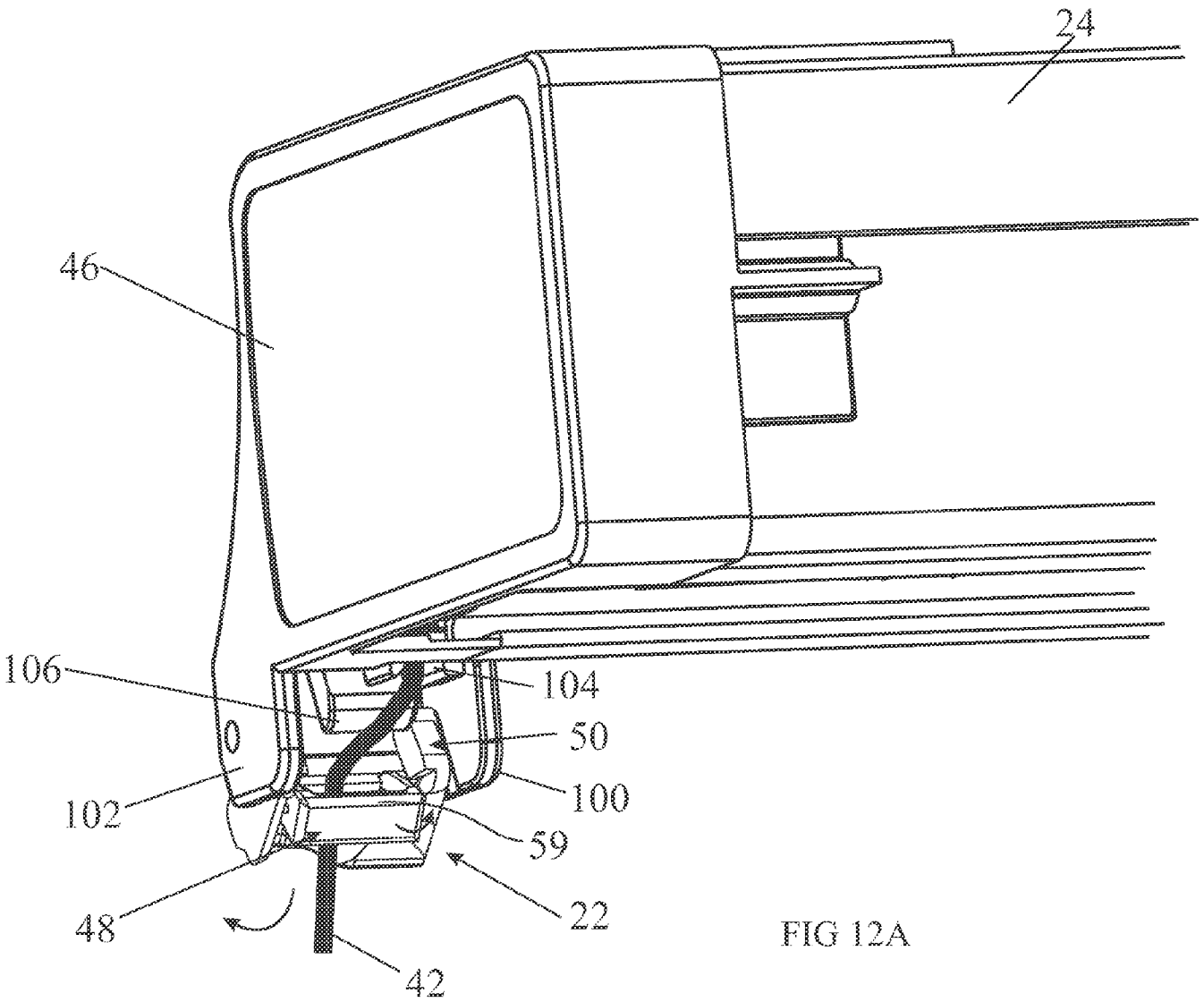
FIG. 12A is a broken-away, perspective view of the bail lock along line 12A-12A of FIG. 1, showing the drive cord tracked to the open (unlocked) area of the bail.

FIG. 12A shows that the bail lock housing 46 has a downwardly projecting tongue 106 against which the trailing edge 59 of the inner bail 48 pinches the cord 42, as explained in more detail later. The drive cord 42 is routed past this tongue 106 and through the framed rectangular area 60 of the inner bail 48.

Figure 10:
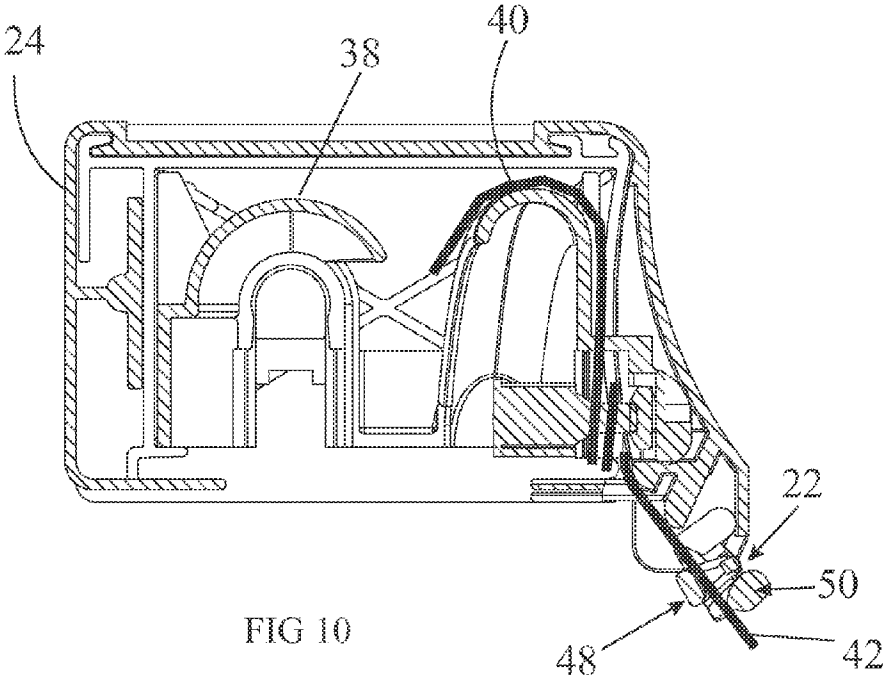
FIG. 10 is a section view along line 10-10 of FIG. 9.
Figure 9:
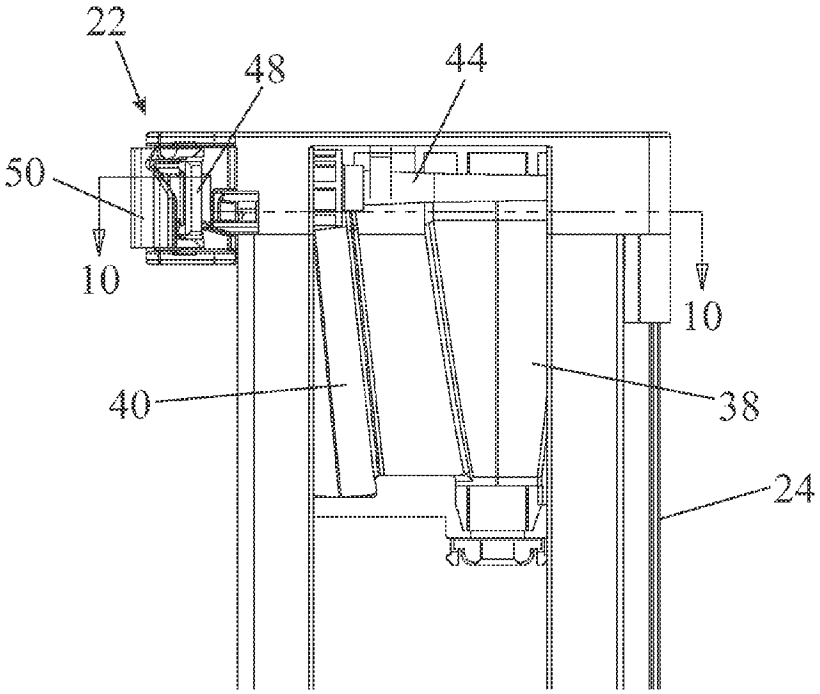
FIG. 9 is a broken-away, view along line 9-9 of FIG. 1.
Figure 11:
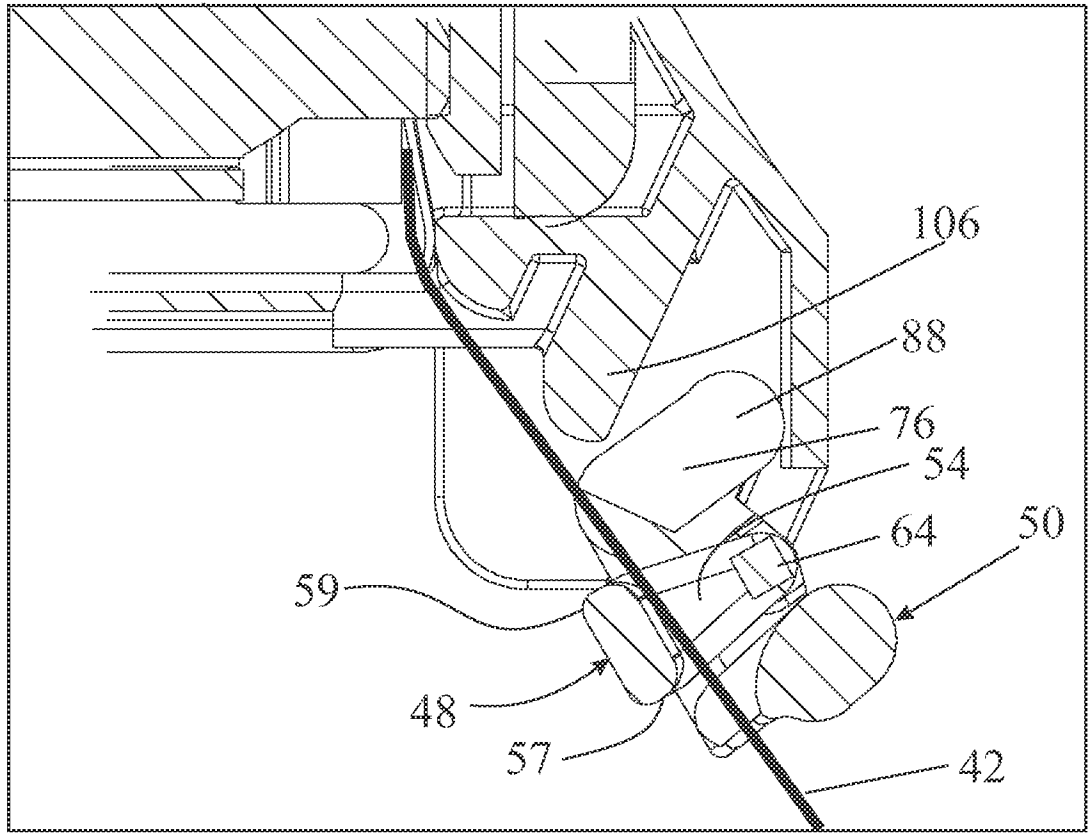
FIG. 11 is a broken-away, detailed view of the bail lock of FIG. 10.

FIGS. 10 and 11 show the bail lock mechanism 22 with the cord 42 tracking along a cord path in which it passes along the low point 82 (See FIGS. 3 and 4) of the guide surface 80 of the outer bail 50 and with the person who is operating the blind pulling on the free end of the drive cord 42 to prevent the outer bail 50 from pivoting clockwise due to gravity about the axis of the stub shafts 86, 88. In this position, there is little or no bend in the cord 42, so there is little or no friction being applied to the cord 42 by the bail lock 22. For the fastest extension of the covering, the operator holds the cord 42 in the position shown in FIG. 11 and allows the cord 42 to slip through his fingers as the cord 42 surges the capstan 44.

If the operator releases the cord 42 in this position, the free end of the cord 42 will move to a vertical position, which puts a greater bend in the cord 42 and creates greater friction between the cord 42 and the bail lock. Also, the outer bail 50 will rotate clockwise due to gravity. Depending upon the weight of the blind, the weight of the tassel at the end of the cord 42, and other design parameters, the increased friction may be sufficient to stop the cord 42 from surging the capstan 44, thereby preventing any movement of the blind, or the increased friction may not be sufficient to stop the cord 42 from surging the capstan 44, in which case the cord 42 will continue to surge the capstan 44 and allow the blind to lower itself in a controlled, gradual manner.

Figure 15:
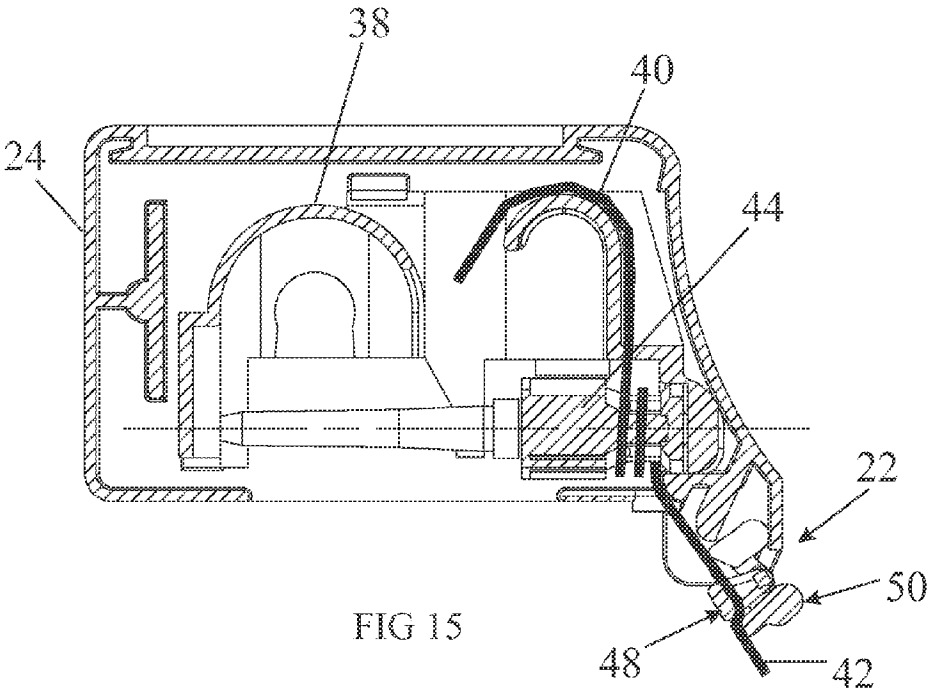
FIG. 15 is a section view along line 15-15 of FIG. 14.
Figure 14:
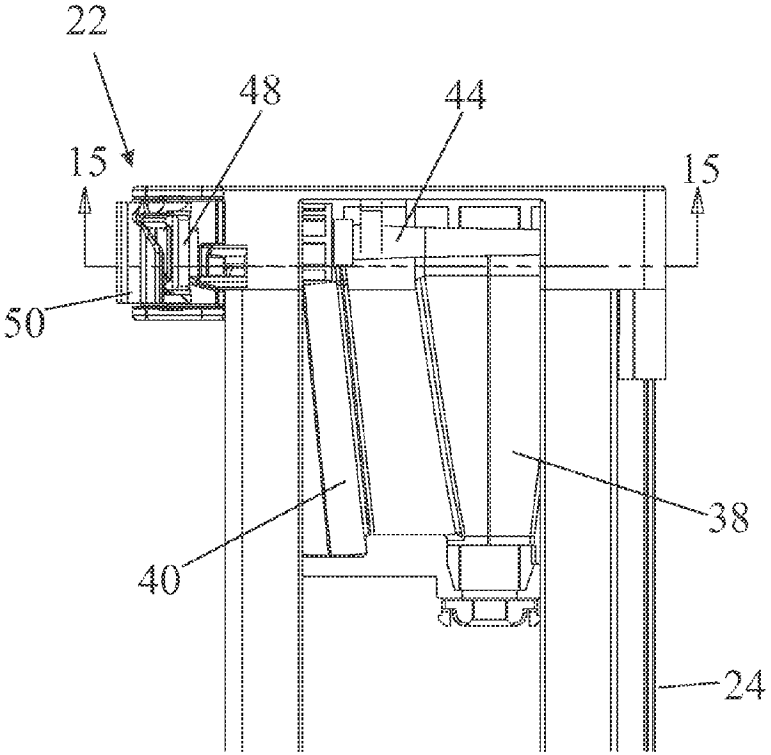
FIG. 14 is the same view as FIG. 9 but with the bail lock in the partially closed position.
Figure 16:
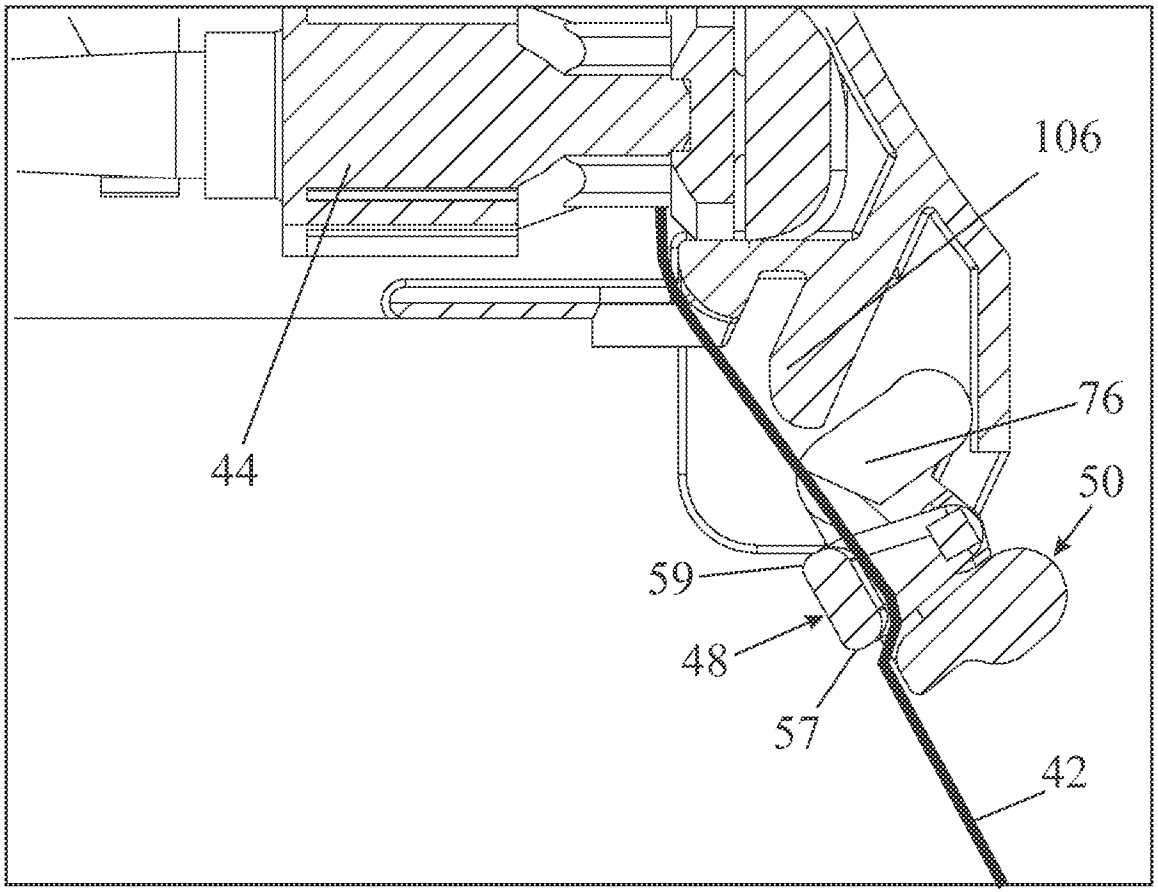
FIG. 16 is a broken-away, detailed view of the bail lock of FIG. 15, with the drive cord tracked to the closed area of the bail in an initial stage of the locking phase, before the bail has rotated upwardly to lock against the housing.
Figure 17:
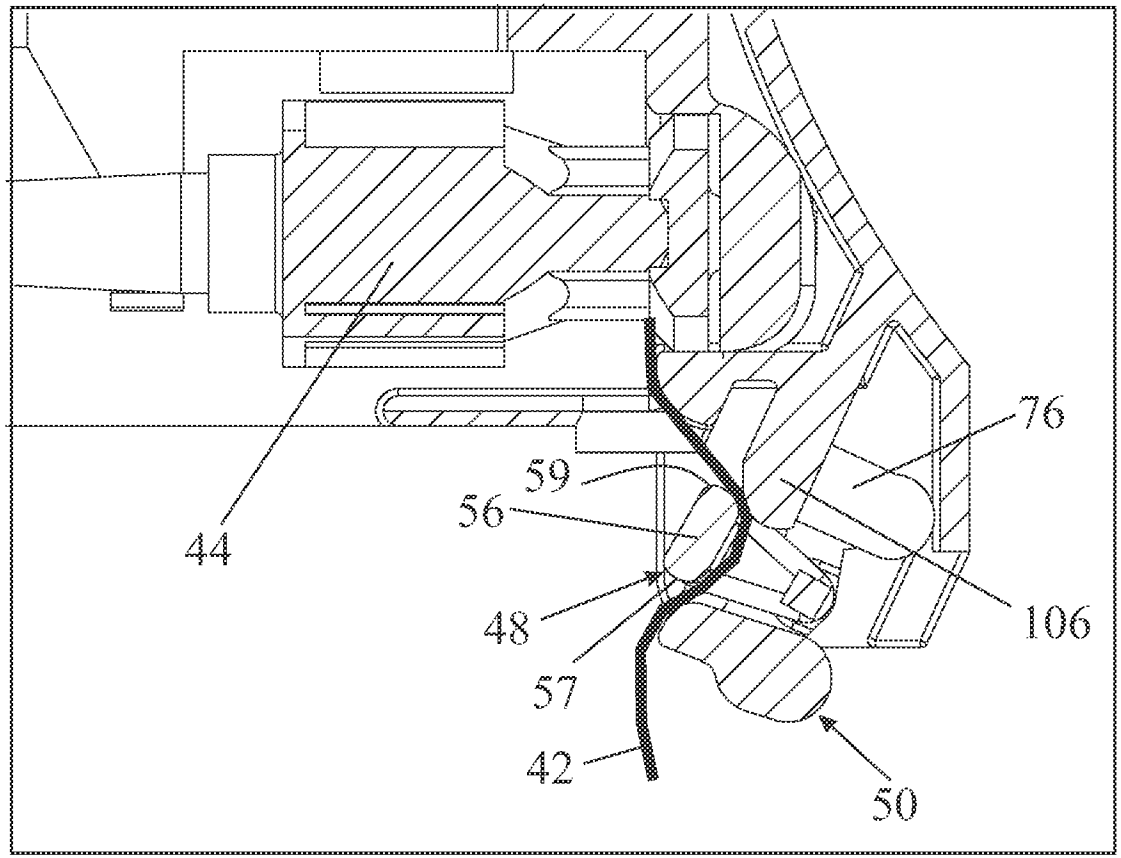
FIG. 17 is a section view, similar to FIG. 16, but in the final stage of the locking phase, after the bail has rotated upwardly to lock against the housing.

FIGS. 15 and 16 show the cord 42 tracking a path along the high portion 84 (See FIGS. 3 and 4) of the guide surface 80, with the operator pulling on the second end of the cord 42 to prevent the outer bail 50 from pivoting clockwise due to gravity. It will be noted that, along this path, there is a substantial bend in the cord 42 where it passes from the inner bail 48 and around the guide surface 80 of the outer bail 50 (compare FIG. 16 will FIG. 11 to see the increased bend of the cord 42). This creates friction between the cord 42 and the inner bail 48 and between the cord 42 and the outer bail 50. If the operator releases the cord 42 in this position, the force of gravity and the friction between the cord and the outer bail 50 cause the outer bail 50 to rotate clockwise to the position shown in FIG. 17, where the cord 42 is pinched between the trailing edge 59 of the inner bail 48 and the tongue 106, creating enough friction on the cord 42 to prevent the cord 42 from surging the capstan 44, which prevents the covering from lowering.

It should be noted that, in addition to the guide surface 80 varying in height along its length in order to provide an area of low resistance and an area of high resistance to the travel of the cord 42, the profile of the rail 56 also may vary along its length in order to facilitate the change in the resistance in the appropriate areas. For example, the portion of the rail 56 that is opposite the high portion 84 of the guide surface 80 may be formed with a sharper radius than the portion of the rail 56 that is opposite the low portion 82. This would increase the amount of friction between the cord 42 and the rail 56 in the area that is designed to increase the holding force, and reduce the amount of friction between the cord 42 and the rail 56 in the area that is designed to provide a minimal holding force.

Figure 18:
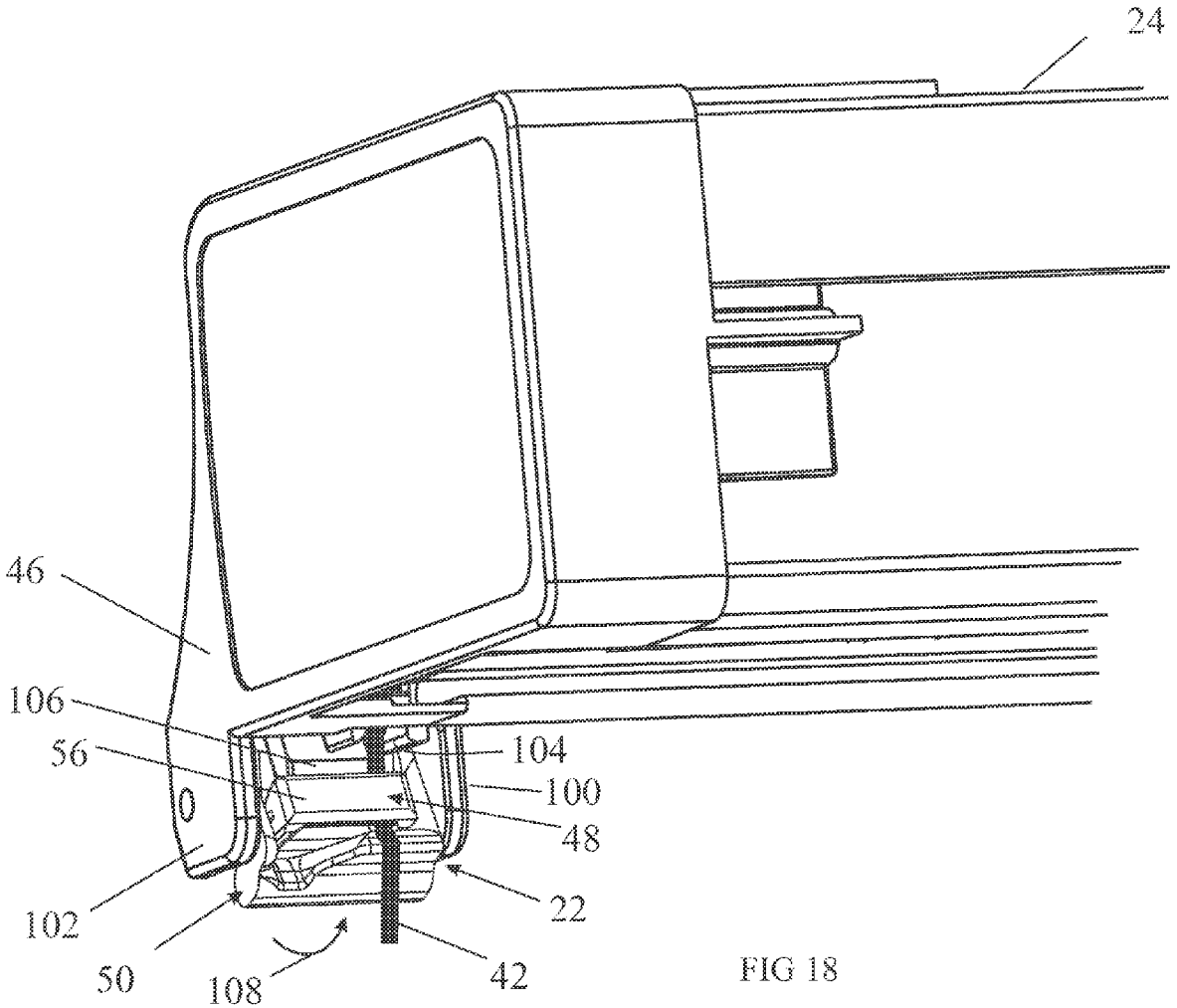
FIG. 18 is the same view as FIG. 12A, but showing the drive cord tracked to the closed (locked) area of the bail and the bail in the locked position.

Operation:

Referring now to FIGS. 1, 2, and 9-12A, in order to raise the shade 20, the user grabs the free end of the drive cord 42 and pulls down and to the right on it (as seen from the vantage point of FIG. 1, which is the same as pulling to the left as seen from the vantage point of FIGS. 12A and 18). The bail lock mechanism 22 will unlock and the drive cord 42 will track along the lowest portion 82 of the cord contact surface 80, which is the "open" area of the bail lock mechanism 22, as seen in FIGS. 12 and 12A. As seen in FIGS. 10-12, when the drive cord 42 is tracking along the "low" point 82 of the cord-contact surface 80 and the operator is holding the cord out at an angle to the vertical, there is little or no bend in the cord 42, and the bail lock 22 applies a negligible amount of friction to the cord 42, so the cord 42 is able to pass freely through the bail lock mechanism 22. The shade 20 also may be raised by pulling down on the free end of the drive cord 42 without pulling to the left, although this would require the use of a bit more force by the operator due to the increased frictional resistance offered by the bail lock mechanism 22 when operating on this side of the cord contact surface 80.

For lowering the shade, the user may hold and guide the cord 42 as it travels up through the "low point" portion 82 of the bail lock mechanism 22 in order to minimize friction and maximize the rate at which the cord 42 surges the capstan 44 and allows the blind to be lowered, or he may simply release the drive cord 42 and "walk away". Depending upon the weight of the blind and other design parameters, the increase in friction due to the change in angle of the cord 42 as it falls to the vertical position may be sufficient to stop the cord 42 from surging the capstan 44 and therefore stop the lowering of the blind, or the cord 42 may continue to surge the capstan 44 and wind onto the spool 36 of the cord drive mechanism 34 as the weight of the shade 20 pulls the shade 20 to its lowered (extended) position.

In this position of the bail lock mechanism 22, the lowering speed of the shade 20 is dictated, in large part, by how readily the drive cord 42 surges the capstan 44. If desired, weight could be added to the free end of the cord to further increase the friction when the cord 42 is released.

To slow down the rate of lowering of the shade 20, the user may move the drive cord 42 to the left (which is equivalent to moving it to the right as seen from the vantage point of FIGS. 12, 12A, and 18) so that the drive cord 42 passes through the steadily rising portion 83 of the cord-contact surface 80, somewhere in between the low point 82 and the high point 84 of the cord-contact surface 80. The amount of frictional resistance that is applied to the drive cord 42 depends upon its position along that rising surface portion 83. The closer the drive cord 42 tracks toward the high point 84 of the cord-contact surface 80, the more resistance the drive cord 42 will experience when passing through the bail lock mechanism 22, and the slower the drive cord 42 will be able to surge the capstan 44 (if it can surge the capstan at all).

Figure 13:
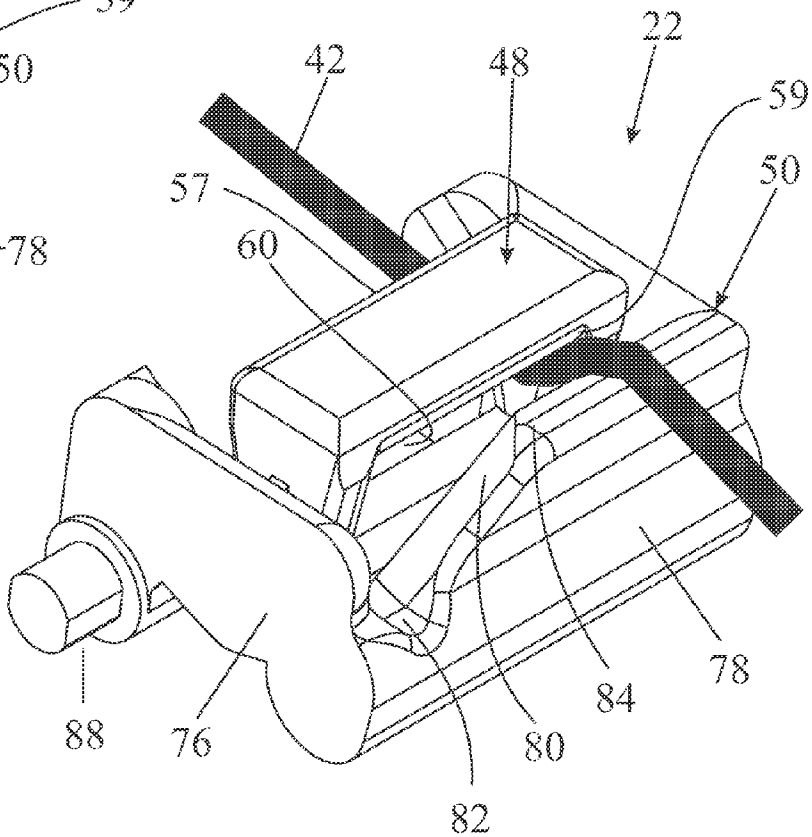
FIG. 13 is a perspective view, similar to that of FIG. 12, but showing the drive cord tracked to the closed (locked) area of the bail.

If the user moves the drive cord 42 all the way to the left (which is equivalent to moving it to the right as seen from the vantage point of FIGS. 12A, 13, and 18), the bend in the drive cord 42, shown in FIGS. 15 and 16 creates greater friction between the drive cord 42 and the cord-contact surface 80 of the outer bail 50. If the operator releases the cord 42 so that the free end of the cord 42 falls to a vertical position, the bend in the cord 42 further increases, which further increases the friction between the cord 42 and the bail lock. In addition, the drive cord 42, which is being pulled upwardly by the weight of the covering, causes the outer bail 50 to rotate clockwise about the axis of its stub shafts 86, 88 to the position shown in FIG. 17, where the trailing edge 59 of the outer rail 56 of the inner bail 48 pinches the drive cord 42 against the tongue 106 of the bail lock housing 46. This provides enough of a load to cinch the drive cord 42 to the capstan 44 such that the shade 20 is prevented from further lowering.

FIG. 18 has an arrow 108 that shows the direction in which the bail 50 pivots in order to pinch the cord 42 between the tongue 106 and the inner bail 48 in order to prevent the shade 20 from further lowering.

As indicated earlier, the holding force required of the bail lock mechanism 22 is relatively low because it only needs to provide enough of a load to cause the cinching effect on the capstan 44. A relatively small load applied by the bail lock mechanism 22 results in a large holding force provided by the capstan 44, so the combined cinching effect on the capstan 44 and the holding force of the bail lock mechanism 22 holds the shade 20 in place. The low force requirements on the bail lock mechanism 22 allow it to be generously radiused and to be made from materials such as plastic which are less abrasive on the drive cord 42 than sharp metal edges.

Of course, the bail lock mechanism 22 need not be used in conjunction with another braking system such as the capstan 44 described above. It may be used by itself, as other prior art bail locks, in which case it may be designed and manufactured such that it has more aggressive holding properties, if desired, in order to provide the full holding force needed to hold the covering 20 in place.

It should be noted that, while the open area in this embodiment is on the right, it could alternatively be on the left, and the bail lock could be located on the other end of the shade 20 if desired. It will be obvious to those skilled in the art that various other modifications may be made to the embodiment described above without departing from the scope of the present invention as claimed.

What is claimed is:

1. An arrangement for covering an architectural opening, comprising:

a covering material;

a cord having a first end and a second end, wherein said first end is operatively connected to the covering material for extending and retracting the covering material and the second end is accessible to be pulled by a user; and a bail lock mechanism including:

an outer bail and an inner bail, wherein said inner bail and outer bail define a cord passage gap between the inner bail and the outer bail and at least one of said inner and outer bails defines a cord guide surface having a left end and a right end and varying in cross-sectional profile from left to right;

wherein the cord passes through the cord passage gap between the inner bail and the outer bail, and wherein there are at least two paths along which the cord can track as it travels through the cord passage gap, including a first path, along a portion of the cord guide surface having a first front-to-back cross-sectional shape, where there is a first amount of bend in the cord and a first amount of friction applied to the cord by the bails, and a second path, along a portion of the cord guide surface having a second front-to-back cross-sectional shape, where there is a greater bend in the cord and greater friction applied to the cord by the bails;

and further comprising a capstan, wherein a portion of the cord between the first end of the cord and the bail lock mechanism is wrapped around the capstan;

wherein pulling the second end of said cord raises the covering material, and wherein, when the cord is tracking along the first path and the user releases the cord, the friction applied to the cord by the bail lock is low enough that the cord surges the capstan and the covering material lowers in a controlled, gradual manner.

2. An arrangement for covering an architectural opening as recited in claim 1, wherein, when the cord is tracking along the second path and the user releases the cord, the friction applied to the cord by the bail lock is great enough to prevent the cord from surging the capstan.

3. An arrangement for covering an architectural opening, comprising:

a covering material;

a cord having a first end and a second end, wherein said first end is operatively connected to the covering material for extending and retracting the covering material and the second end is accessible to be pulled by a user; and a bail lock mechanism including:

an outer bail and an inner bail, wherein said inner bail and outer bail define a cord passage gap between the inner bail and the outer bail and at least one of said inner and outer bails defines a cord guide surface having a left end and a right end and varying in cross-sectional profile from left to right;

wherein the cord passes through the cord passage gap between the inner bail and the outer bail, and wherein there are at least two paths along which the cord can track as it travels through the cord passage gap, including a first path, along a portion of the cord guide surface having a first front-to-back cross-sectional shape, where there is a first amount of bend in the cord and a first amount of friction applied to the cord by the bails, and a second path, along a portion of the cord guide surface having a second front-to-back cross-sectional shape, where there is a greater bend in the cord and greater friction applied to the cord by the bails; and wherein said cord guide surface is on said outer bail and the change in front-to-back cross-sectional profile of the guide surface includes a change in height; wherein said inner bail is mounted on said outer bail for pivotal rotation relative to said outer bail; and wherein said inner bail has an outer rail which defines a leading edge adjacent said cord guide surface, and a trailing edge opposite the leading edge.

4. An arrangement for covering an architectural opening as recited in claim 3, and further comprising a capstan, wherein a portion of the cord between the first end of the cord and the bail lock mechanism is wrapped around the capstan.

5. An arrangement for covering an architectural opening as recited in claim 4, wherein said bail lock further comprises a housing including a stationary tongue; wherein said outer bail is mounted on said housing for pivotal rotation relative to said stationary tongue, and wherein, when the second end of said cord is pulled away from said bail lock, causing said cord to move in a first direction, said outer bail pivots in one direction which moves said trailing edge of said inner bail away from said tongue, and when said cord is tracking along the second path and moves in a second direction opposite the first direction, said outer bail pivots to push said trailing edge of said inner bail toward said tongue to pinch the cord between the tongue and said trailing edge of said inner bail.

6. An arrangement for covering an architectural opening as recited in claim 3, wherein said bail lock further comprises a housing including a stationary tongue; wherein said outer bail is mounted on said housing for pivotal rotation relative to said stationary tongue, and wherein, when the second end of said cord is pulled away from said bail lock, causing said cord to move in a first direction, said outer bail pivots in one direction which moves said trailing edge of said inner bail away from said tongue, and when said cord is tracking along the second path and moves in a second direction opposite the first direction, said outer bail pivots to push said trailing edge of said inner bail toward said tongue to pinch the cord between the tongue and said trailing edge of said inner bail.

7. An arrangement for covering an architectural opening as recited in claim 6, and further comprising a capstan, wherein a portion of the cord between the first end of the cord and the bail lock mechanism is wrapped around the capstan;

wherein pulling the second end of said cord raises the covering material, and wherein, when the cord is tracking along the first path and the user releases the cord, the friction applied to the cord by the bail lock is low enough that the cord surges the capstan and the covering material lowers in a controlled, gradual manner.

8. An arrangement for covering an architectural opening as recited in claim 7, wherein, when the cord is tracking along the second path and the user releases the cord, the friction applied to the cord by the bail lock is great enough to prevent the cord from surging the capstan.

* * * * *